US005635905A

United States Patent [19]

Blackburn et al.

[11] Patent Number: 5,635,905

[45] Date of Patent: Jun. 3, 1997

[54] SYSTEM FOR DETECTING THE PRESENCE OF AN OBSERVER

[76] Inventors: Ronald E. Blackburn, 43552 Southerland Way, Fremont, Calif. 94539; Barry M. Warmkessel, 767 Chopin Dr., Sunnyvale, Calif. 94087

[21] Appl. No.: 382,686

[22] Filed: Feb. 2, 1995

[51] Int. Cl.[6] ..... G08B 13/18

[52] U.S. Cl. ..... 340/555; 250/221; 340/556; 340/557; 348/152; 351/210; 364/516

[58] Field of Search ..... 340/557, 556, 340/555, 541, 511, 426, 576; 250/221; 128/745; 351/209, 210, 221; 348/152–155; 356/375; 359/155; 367/93–94; 342/27–28; 364/516–517

[56] References Cited

U.S. PATENT DOCUMENTS

| | | | |
|---|---|---|---|
| 3,825,916 | 7/1974 | Steele et al. | 340/557 |
| 3,986,030 | 10/1976 | Teltscher | 351/210 X |
| 4,397,531 | 8/1983 | Lees | 351/210 |
| 4,684,929 | 8/1987 | Edwards et al. | 340/541 |
| 5,194,847 | 3/1993 | Taylor et al. | 340/557 |
| 5,305,390 | 4/1994 | Frey et al. | 340/556 X |

FOREIGN PATENT DOCUMENTS

| | | | |
|---|---|---|---|
| 240336 | 10/1987 | European Pat. Off. | 351/210 |
| 2324008 | 11/1974 | Germany | 340/557 |
| 2215040 | 9/1989 | United Kingdom | 340/575 |

*Primary Examiner*—Thomas Mullen
*Attorney, Agent, or Firm*—Chris Papageorge

[57] ABSTRACT

A system is disclosed for detecting the presence of a human who may be observing an artifact which is within his or her line of sight or field of view. The system includes a laser with a lens at the output thereof and which is triggered rapidly in order to produce a pulsed beam having divergent rays of visible or invisible infrared light which irradiates an area to be examined for the presence of an observer. The light reflected from individuals and objects in the area is reflected into a pair of vision devices or pair of vision device assemblies the outputs of which are fed into a computer. The computer has software programs which utilize vision device output data relating to the intensity and location of the light pixels in the image thereof to detect the presence and orientation of the eyes of an individual in the area based on the light pixel intensity and location data.

26 Claims, 12 Drawing Sheets

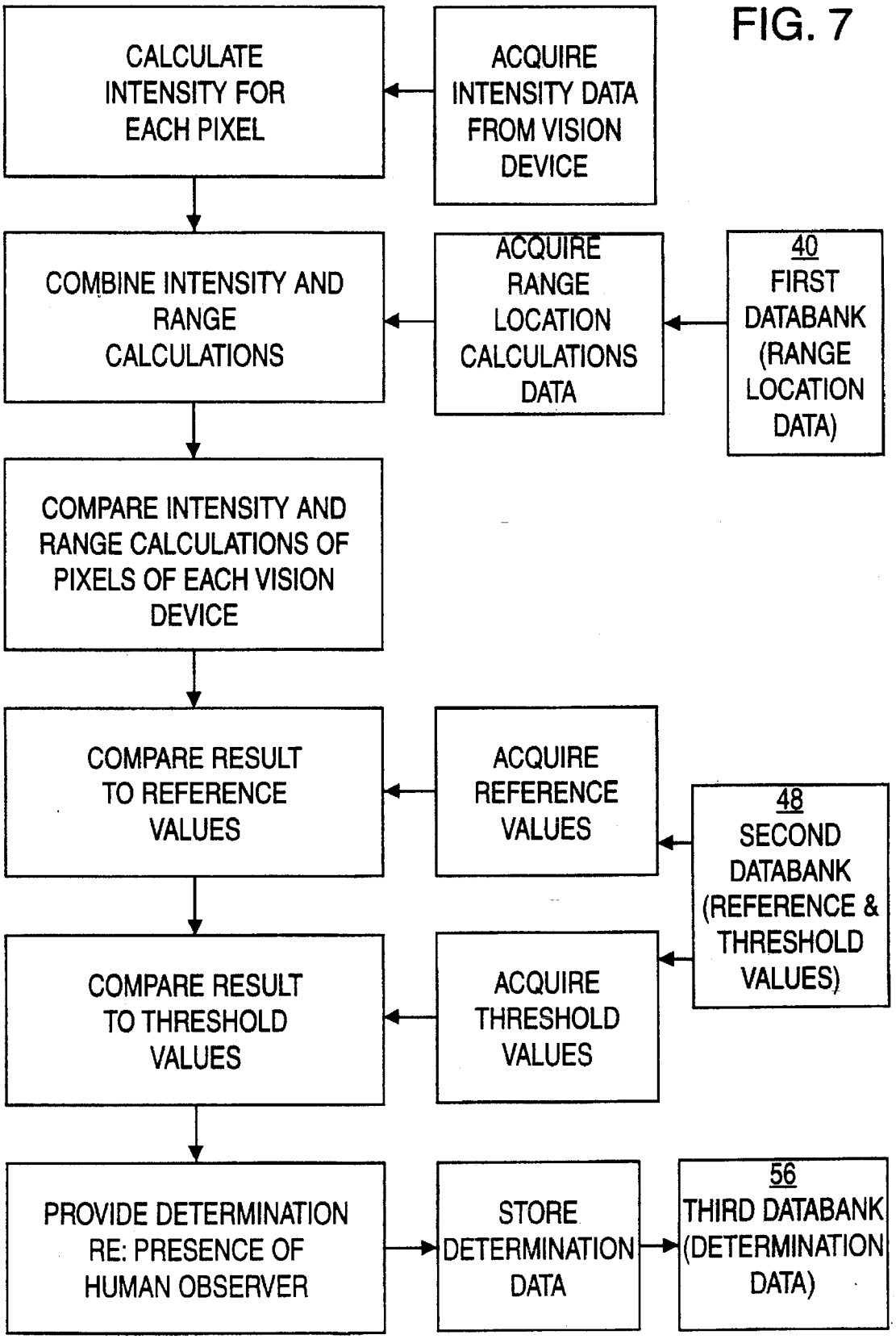
FIG. 7
CALCULATE INTENSITY FOR EACH PIXEL
ACQUIRE INTENSITY DATA FROM VISION DEVICE
COMBINE INTENSITY AND RANGE CALCULATIONS
ACQUIRE RANGE LOCATION CALCULATIONS DATA
40
FIRST DATABANK (RANGE LOCATION DATA)
COMPARE INTENSITY AND RANGE CALCULATIONS OF PIXELS OF EACH VISION DEVICE
COMPARE RESULT TO REFERENCE VALUES
ACQUIRE REFERENCE VALUES
48
SECOND DATABANK (REFERENCE & THRESHOLD VALUES)
COMPARE RESULT TO THRESHOLD VALUES
ACQUIRE THRESHOLD VALUES
PROVIDE DETERMINATION RE: PRESENCE OF HUMAN OBSERVER
STORE DETERMINATION DATA
56
THIRD DATABANK (DETERMINATION DATA)

SYSTEM FOR DETECTING THE PRESENCE OF AN OBSERVER

BACKGROUND OF THE INVENTION

The present invention relates generally to systems for detecting the presence of humans in an area and, more specifically, to such systems for determining whether the humans in the area are observing an installation, artifact or person.

There are many electronic and optical devices and systems currently available for allowing the observation of persons without the observee's knowledge or consent. Many of such devices and systems allow such observation at night or in an area of low illumination or at such a great distance that the observee could not easily see or otherwise be aware of such observation. In addition, such devices and systems are not uncommonly used in conjunction with eavesdropping devices which allow monitoring of confidential communications in addition to identification of the persons making the communications and observance of their behavior. The sophistication of such devices and systems has increased markedly, and this has facilitated their cryptic and effective use. However, many people view the proliferation of such devices and systems as an assault on the privacy of individuals. In addition, the effectiveness and ease of use of such devices and systems has made it harder to preserve the secrecy of governmental installations and the programs conducted therein as well as industrial plants and buidings which may be utilizing trade secrets in their manufacturing processes. In fields of business in which a competitive edge may be all important to the success of a business, the vulnerability of business processes and practices which utilize trade secrets to surveillance may result in the untimely failure of such businesses. Many private individuals may also find themselves vulnerable in their personal, professional and business lives by use of such devices and systems in surveillance of their homes, offices, etc. Moreover, many people may be psychologically harmed, emotionally distressed or simply feel ill at ease by the thought or belief that persons unknown may be watching them. In this regard, much of the unauthorized surveillance or observation that takes place is conducted by persons who may be on public property or otherwise not in a location in which their presence may violate the law. Consequently, such surveillance may not be easily prevented. However, such surveillance may be actionable under law if its nature or existence can be established.

Although many devices and systems to aid in unauthorized surveillance or observation are commonly available, far fewer devices and systems are available to detect the existence of and determine the nature of such surveillance or observation. Consequently, what is needed is a system to detect the presence of an observer, to determine generally what is being observed and to perform such detection at a moderate distance from the observer.

SUMMARY OF THE INVENTION

It is a principal object of the present invention to provide a detection system for detecting the presence of a human observer in an area.

It is an object of the present invention to provide a detection system for detecting the presence of a human observer in an area which can determine the orientation of the observer's eyes in order to determine what is being observed by the observer.

It is also an object of the present invention to provide a detection system for detecting the presence of a human observer in an area from a location at a moderate distance from the area.

It is also an object of the present invention to provide a detection system for detecting the presence of a human observer in an area without alerting the observer to the existence of such detection.

It is also an object of the present invention to provide a detection system for detecting the presence of a human observer in an area which may have a wide range of degrees of illumination or lack thereof.

It is another object of the present invention to provide a detection system for detecting the presence of a human observer in an area which may provide such detection quickly.

It is another object of the present invention to provide a detection system for detecting the presence of a human observer in an area which may provide such detection automatically.

It is also another object of the present invention to provide a detection system for detecting the presence of a human observer in an area which is capable of examining a relatively large area quickly.

Essentially, the detection system of the present invention uses analysis of light reflected from the reflecting surfaces in an area being examined to determine whether there is an observer in the area, distinguish between a human and nonhuman observer and determine the line of sight of the observer and thereby determine generally what the observer is or may be looking at. The detection system basically utilizes a light source, a camera (or a night vision device or other type of light sensor device) and a computer to make the analysis and provide the desired determinations. The light source illuminates the area and the light reflected therefrom is received by a camera or light sensor device. In a first embodiment, the camera has an electrical output which includes data relating to the voltage provided by the camera components which produce pixels of light in the camera image of an intensity corresponding to the intensity of the light reflected into the camera. The electrical output of the camera also includes data relating to the current or voltage provided by the camera components which produce a pixel of light in the camera image at a location therein corresponding to the location of the reflecting surfaces which reflect the light into the camera. Consequently, the camera output includes data which is used by the computer software to calculate both the location of the reflecting surfaces and the intensity of the light reflected thereby. A second embodiment of the invention provides essentially the same data as the first embodiment but utilizes an electromechanical and optical system rather than an electronic and optical system as in the first embodiment. In the second embodiment, the light reflected from the illuminated area is received by primary night vision devices which activate phosphors thereof in response to the light received by the devices. The top disk of a spinning dual disk reticle having radial slits therein receives the light prior to its entry into the primary night vision devices while the bottom disk receives the light produced by the glowing phosphors. The light produced by the phosphors which passes through the reticle is received by the secondary night vision devices. The position of the slits which allow the light to pass through the reticle is utilized to determine the bearing, azimuth and elevation of the objects in the area which reflect the particular pixels of light into the vision devices. In addition, the primary night vision devices are connected to surge current detectors which have an electrical output which provides data relating to the intensity of the light received thereby.

At certain wavelengths, human eyes reflect a high proportion of the light illuminating them particularly if the illuminating light is normal or nearly normal to the corneas of the eyes. This is exemplified in color photographs taken by use of flash illuminators which sometimes show people therein having bright red eyes. In contrast, light reflected from trees, grass and other objects found in the typical outdoor environment reflect light diffusely and thereby produce reflected light which is markedly reduced in intensity compared to the intensity of the illuminating light. Consequently, human eyes in an area will produce a reflected light image which has a higher intensity or amplitude than that of the background surfaces. This relatively higher intensity of the light reflected from the eyes will result if the light source is in the field of view of the eyes and will reach a maximum when the light source is directly in the line of sight of the eyes. Consequently, the existence of reflected light pixels from the area which are relatively bright in comparison to predetermined values will yield a determination that there are human eyes in the area. Thus, calculation of the relative intensity of the light pixels from the reflecting surfaces in the area by the computer software enables a determination of whether there is a human observer in the area.

The location of the reflecting surfaces is determined by utilizing the camera output data relating to light pixel locations in the camera image or surge current detector output data relating to the angular position of the dual reticle slits when light passing through the slits illuminates the appropriate night vision device in conjunction with data relating to the field of irradiation of the light source and in conjunction with data relating to the distances of the reflecting surfaces in the area from the light source and/or the camera. In the first embodiment, the distances of the reflecting surfaces are obtained by standard range finding techniques based on phase comparison of modulated transmitted and received light and computer calculations of the transit time of a predetermined phase point of the modulating wave of the light from the source to the reflecting surfaces and to the camera and utilizing the speed of light. In the second embodiment, the distances of the reflecting surfaces are obtained by standard range finding techniques based on time of transmission and time of arrival (at the primary night vision devices) data of laser pulses. The locations of the pixels in the camera image or the position of the dual reticle slits at the time of corresponding surge current detector outputs are computer correlated to the field of irradiation of the light source and thereby to the area irradiated resulting in a determination regarding the locations of the reflecting surfaces in the area. Consequently, the detection system of the present invention provides both a determination regarding the presence of an observer and the location of such an observer. Moreover, the determination regarding the location of the reflecting surfaces can provide the separation distance of the pair of eyes further buttressing the other determination regarding identification of the reflecting surfaces being a pair of human eyes (based on the relative intensity of the light reflected from the eyes). Additionally, the determination regarding the location of the reflecting surfaces in conjunction with the calculated intensity of the reflected light therefrom enables computer calculation of the orientation of the eyes which is utilized to provide a computer determination regarding the line of sight of the eyes and thereby a determination of the direction in which the observer is looking.

BRIEF DESCRIPTION OF THE DRAWINGS

FIG. 7 is a flowchart of a first software program of the detector system of the present invention utilized to differentiate between human observers, nonhuman observers and inanimate objects in the area examined.

DETAILED DESCRIPTION OF THE PREFERRED EMBODIMENT

Figure 1:
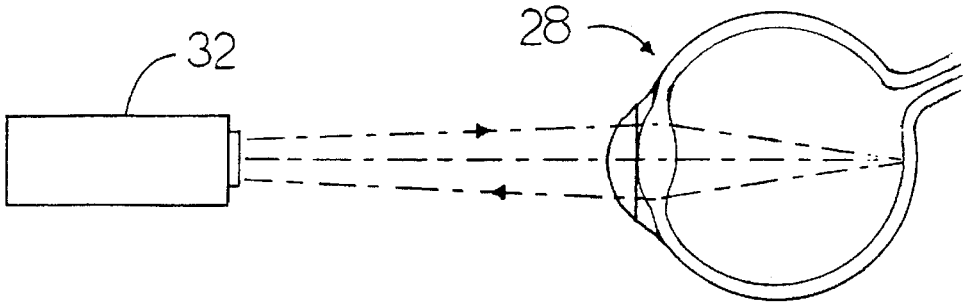
FIG. 1 is a diagram showing a laser emitting a beam of light passing through the lens of an eye and reflected from the retina thereof directly back to the laser and thereby illustrating a theory of operation of the detector system of the present invention.
Figure 2:
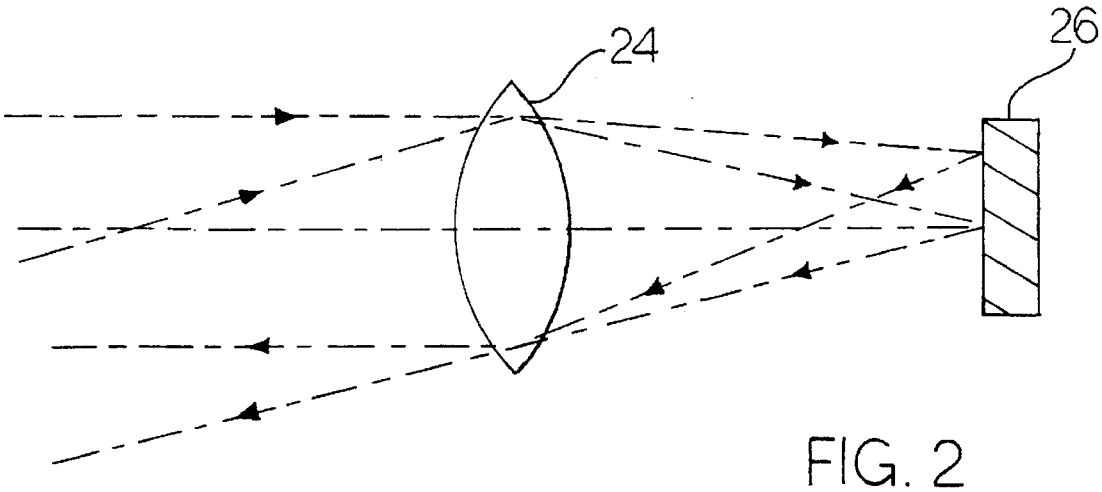
FIG. 2 is a diagram showing two beams of light (from two separate angularly positioned light sources) passing through the lens of an eye and reflected from the retina thereof directly back to the sources of the light also thereby illustrating a versatile theory of operation of the detector system of the present invention.
Figure 3:
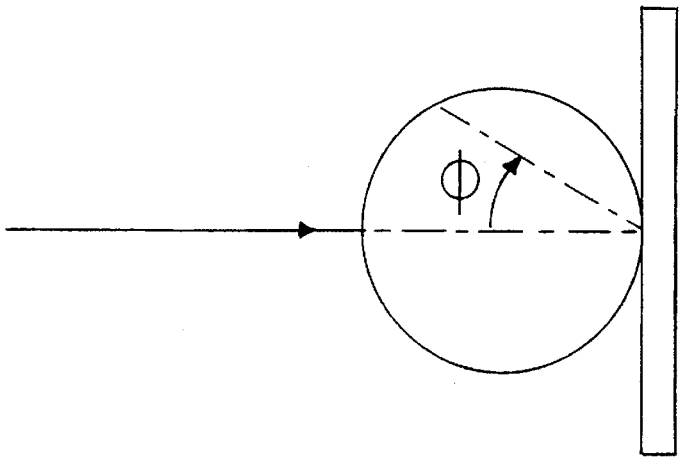
FIG. 3 is a diagram showing a beam of light reflected from a planar diffuse reflector i.e., non-eye reflector, in a direction away from the source of the light also illustrating a theory of operation of the detector system of the present invention.

Referring to the drawings, FIG. 1 shows a laser illuminating an eye with a beam of light which is reflected directly back to the laser. The illuminating laser and receiving unit must be co-axial or the optical signatures of the eye degrades. FIG. 2 shows two light beams from two lasers (not shown) illuminating the lens and retina of an eye and reflected back therefrom opposite to the initial direction of propagation of the light toward the laser. The light beam of FIG. 1 is slightly skewed from the normal to the lens and the light beams and lasers of FIG. 2 are at separate and diverse angular positions with respect to each other which illustrate that light beams which are normal to the lens of the eye and light beams which are skewed to a certain degree from the normal to the lens of the eye are both reflected back to the laser light source. In contrast, FIG. 3 shows that a light beam from a laser which illuminates the principle that something having a generally planar surface (a diffuse reflector) and, more specifically, something lacking a focusing lens or concave surface will not reflect light back to the source where the light beam is not normal to the surface and will thus have the constant irradiance profile shown for a point source of light i.e., where the light beams are divergent, light reflected from such a surface will be diffuse. In FIG. 3, the angle $\phi$ is the angle between the incident light beam and the reflected light beam, and the size of this angle depends upon the angle of incidence of the incident beam. Essentially, FIG. 3 illustrates cosine scattering from a diffuse reflector and shows that the majority of light is reflected and the intensity of the reflected light decreases as the angle (with respect to the normal to the plane of the diffuse reflector) of the reflected light increases. The circle shown in FIG. 3 thus represents the constant irradiance profile of the reflected light wherein the profile is rotated so that it is normal to the plane of the reflector in order to more clearly illustrate the direction of the reflected light. FIGS. 1, 2 and 3 thus illustrate the basic theory of operation of the detection system of the present invention which is that light beams illuminating an eye from a light source which is within the field of view of the eye i.e., the observer, will be retroreflected back to the light source whereas light illuminating another part of an observer's body or an inanimate object will not be so retroreflected.

Figure 4B:
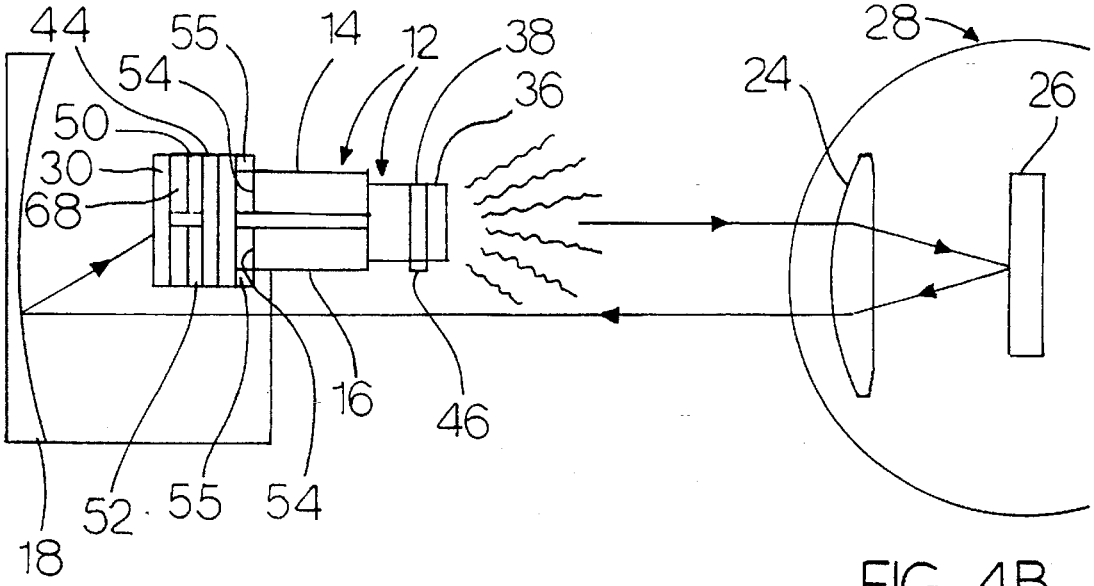
FIG. 4B is a diagram of the first embodiment of the detector system of the present invention showing light emitted from a laser reflected from an eye back to components of the detector system for processing thereof.
Figure 4A:
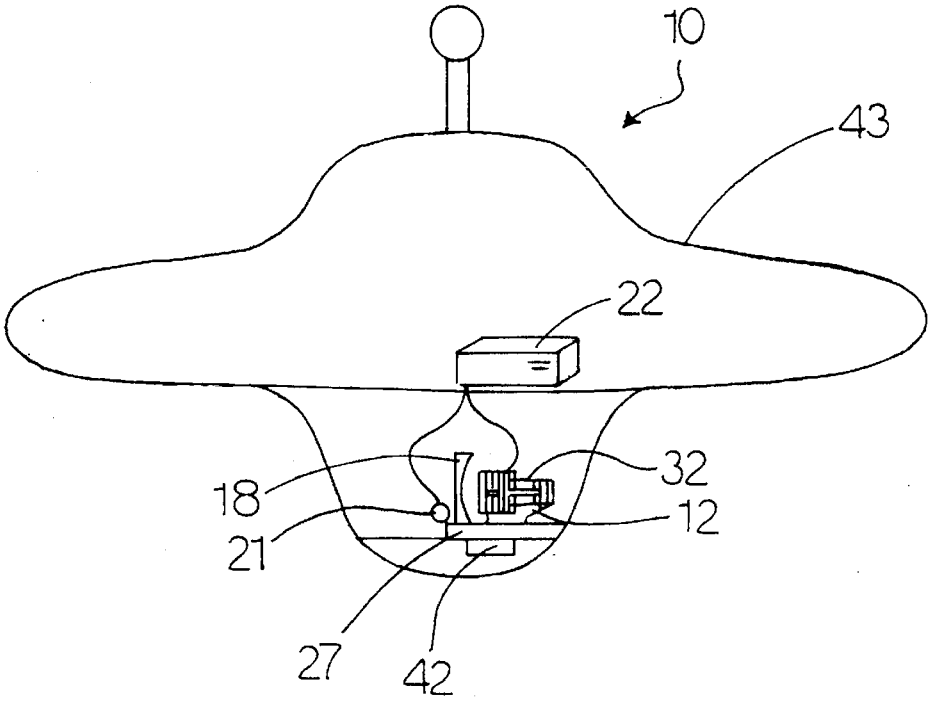
FIG. 4A is a perspective view of a first embodiment of the detector system showing components thereof mounted in a housing and on a rotatable mount in order to scan a relatively large area and showing the housing in cross-section in order to depict the detector system components positioned in the housing.

FIG. 4A shows the first embodiment of the detector system of the present invention generally designated by the numeral 10. The detector system 10 is preferably mounted in housing 43 and includes an electromagnetic radiation source subsystem 12 for irradiating an area in order to examine the area for the presence of an observer. The detector system 10 also includes a pair of cameras (or vision devices) 14 and 16 and a receiving mirror 18 for receiving the radiation from the source subsystem 12 which is reflected from the area. The detector system 10 additionally includes a range circuitry subsystem 21 which is electrically connected to both the source subsystem 12 and the cameras 14 and 16. The detector system 10 also includes a computer 22 which is electrically connected to the range circuitry subsystem 21 and the cameras 14 and 16. The source subsystem 12 and the cameras 14 and 16, range circuitry subsystem 21 and receiving mirror 18 are preferably mounted on a mount 27. The mount 27 is preferably movable and, more preferably, rotatable so that the radiation source subsystem 12 can irradiate (or illuminate) an area larger than the field of irradiation (or illumination) of the radiation source subsystem 12 and concomitantly so that the cameras 14 and 16 can receive radiation reflected from an area larger than the field of irradiation of the radiation source subsystem 12.

FIG. 4B is a diagrammatic view showing the radiation source subsystem 12 irradiating the eye lens 24 and retina 26 of a human eye 28. FIG. 4B illustrates how the lens 24 refracts the radiation impinging thereon so that the ray is directed to and reflected from the retina 26 back to the lens 24 which refracts the ray so that it travels away from the lens 24 in a direction which is opposite to but parallel to the initial direction of propagation of the ray. The retroreflected ray is thus received by the receiving mirror 18. The mirror 18 preferably is concave with its center of curvature selected so that retroreflected beams emitted from the source subsystem 12 which are propagating in a direction parallel to the direction of emission of such rays from the source subsystem 12 and which impinge on the mirror 18 are reflected thereby into the separator 30 and the pair of cameras 14 and 16. As illustrated in FIG. 4B, the retroreflected beam will be directed into the mirror 18 and reflected from the mirror 18 into the separator 30 and cameras 14 and 16 if the radiation source subsystem 12 is irradiating the eye 28 from any location within the field of view of the eye 28. The cameras 14 and 16 will also receive radiation from reflecting surfaces of other objects in the area as well. However, as illustrated in FIG. 3, reflected radiation from other objects in the area will be diffuse and most of the radiation irradiating these objects will not be reflected into the cameras 14 and 16.

Figure 6A:
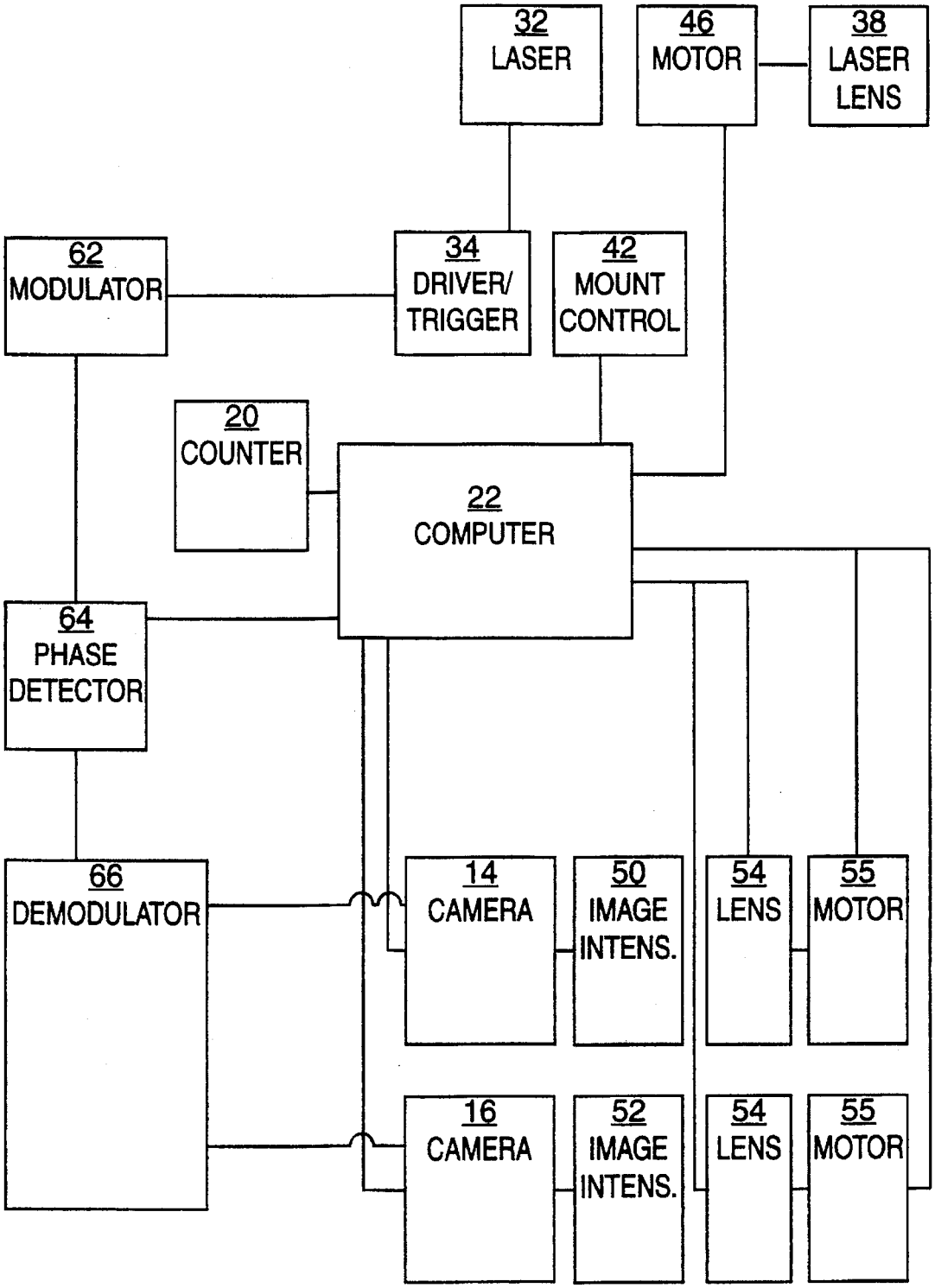
FIG. 6A is a diagram of the first embodiment of the detector system of the present invention showing components thereof and their interconnections.
Figure 6B:
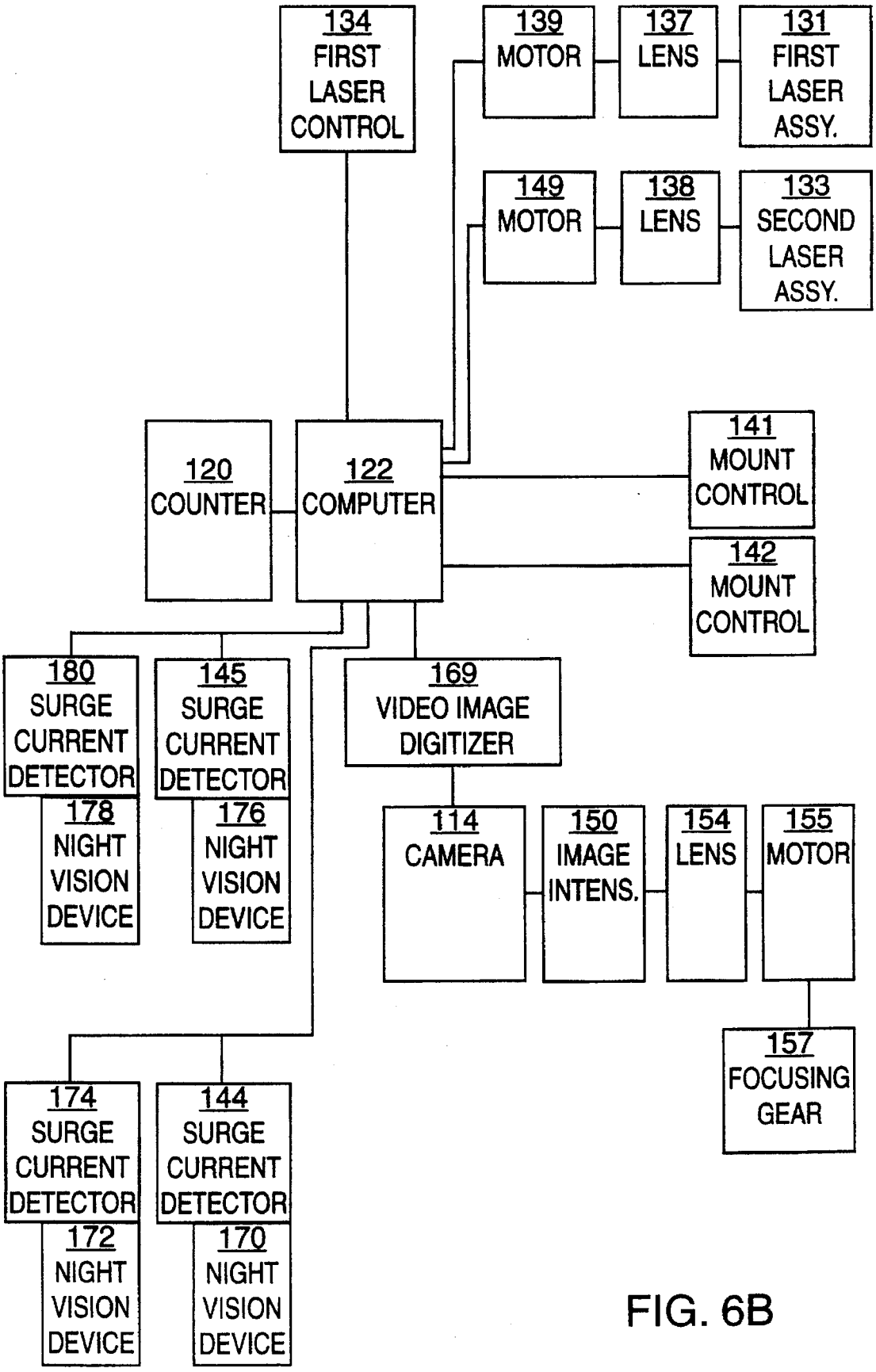
FIG. 6B is a diagram of the second embodiment of the detector system of the present invention showing components thereof and their interconnections.

FIG. 4B shows components of the radiation source subsystem 12 in detail. FIG. 6A shows the interconnections of components of the first embodiment 10 of the detector system. The radiation source subsystem 12 preferably includes a laser assembly 32 (preferably a 0.01 millijoule GaAs laser although a HeNe laser may also be utilized) and a laser control (or driver or trigger) 34. The trigger 34 turns the laser 32 on and off quickly so that the laser beam consists of beam pulses for reasons which will be explained herein below. The laser 32 is preferably a pair of lasers 32 which provide a pair of beams each of which is at one of two selected wavelengths for reasons which will be explained hereinbelow. The pulsed beams are preferably filtered by an interference filter 36 which is positioned at the output of the laser 32 into laser radiation having only two selected wavelengths of desired bandwidths and for isolation of the two beams radiated at the two wavelengths. One of the lasers 32 is preferably a GaAs laser while the other is preferably a HeNe laser providing laser radiation at wavelengths of approximately 0.63 microns and 0.85 microns, respectively. The laser beams are subsequently expanded by a laser lens 38 positioned at the output of the laser 32 so that the rays of the beams of radiation diverge with respect to each other. The divergence of the rays of the laser beams enables the irradiation of an area which is large relative to the width of the collimated i.e., prior to divergence, laser beams. Thus, the field of irradiance of the laser 32 is large which thereby enables the examination of a relatively large area. The beams of radiation preferably have even flux distributions in order to enhance accuracy of the calculations of the desired parameters. The laser lens 38 is preferably a telephoto laser lens 38 which includes a telephoto laser lens motor 46 to alter the magnification of the lens 38 to irradiate a larger or smaller portion of the area, as desired. Although the two lasers 32 preferably simultaneously emit radiation, they may instead alternately emit radiation or one of the lasers 32 may emit radiation during one rotation of the system 10 and the other of the lasers 32 emit radiation during the next rotation of the system 10.

The separator 30 receives the radiation from the laser 32 which is retroreflected from reflecting surfaces in the area directly from the reflection mirror 18. The preferably prism type of separator 30 preferably separates the retroreflected radiation beams into two radiation beams and the pair of second interference filters 68 positioned in the path of the two beams filter out unwanted radiation from both extraneous sources and from the other of the pair of lasers 32 leaving only radiation at the two wavelengths of the radiation emitted from the laser assembly 32. However, if the lasers 32 alternately or in alternate rotation cycles (performed by the mount 27) emit radiation, the second interference filters 68 may be omitted, if desired, thereby leaving only the pulse filter 44 to isolate the received radiation beam from unwanted radiation. The first of the radiation beams has a first wavelength selected so that radiation at that wavelength irradiating the human eye will provide maximal retroreflection therefrom. The second of the radiation beams has a second wavelength selected so that radiation at that wavelength irradiating a chosen animal species (or set of animal species) will provide maximal retroreflection therefrom. Thus, radiation having the first wavelength will provide maximal intensity of retroreflection from human eyes but not from animal eyes of that species. Similarly, radiation having the second wavelength will provide maximal intensity of retroreflection from animal eyes of that species but not from human eyes. The radiation beams preferably have a known or predetermined intensity. Consequently, a comparison of the intensity of the retroreflections at the two wavelengths will enable a determination of whether there are animals of that species and/or humans in the area and also enable differentiation between retroreflections from human eyes and eyes of that species. Moreover, since human eyes are structurally different from all other species of animal, the wavelength selected for maximal retroreflection from human eyes will be likely unique for human eyes. Thus, retroreflections of radiation at that first wavelength from human eyes in the area will stand out in brightness or intensity from retroreflections from all other species of animal in the area. Additionally, since the reflecting surfaces from inanimate objects in the area will be diffuse, as explained hereinabove, the retroreflections from human eyes in the area will also stand out from retroreflections from other objects in the area thereby enabling differentiation between retroreflections from human eyes and objects in the area. Preferably, the two wavelengths are within the infrared portion of the electromagnetic radiation spectrum so that the irradiation cannot be seen by observers in the area. Consequently, the observers in the area would not be aware of detection of their presence.

The two radiation beams preferably pass through the second interference filter 68 and the pulse filter 44 which are preferably positioned in the path of the radiation reflected from the receiving mirror 18. The second interference filter (or pair of filters) 68 filters out radiation which is not at the two selected wavelengths. The pulse filter 44 filters out radiation which is not pulsed at the frequency provided by the trigger 34. Sunlight when reflected off ripples in ponds or other specular sources not uncommonly has enough power in the laser bands to pass through the interference filter and activate the circuitry of the cameras 14 and 16. These reflections often resemble long pulses. The pulse filter 44 rejects such long pulses but accepts short pulses (as the laser pulses should be). Thus, the pulse filter 44 eliminates radiation impinging on the receiving mirror 18 which is from extraneous radiation sources. Moreover, the pulse filter 44 and second interference filters 68 by performing the same filtration function in different ways together provide radiation beams to the cameras 14 and 16 which are of enhanced purity i.e., isolated from undesired radiation. The trigger 34 preferably provides a laser beam pulsed at approximately one-thousand pulses per second. This rate of pulsation is sufficient for filtering out radiation from extraneous sources.

The pair of radiation beams are preferably transmitted from the separator 30 through the second interference filters 68 and the pulse filter 44 to the cameras 14 and 16 with one camera 14 receiving the first of the pair of radiation beams at the first wavelength and the other camera 16 receiving the second of the pair of radiation beams at the second wavelength. Thus, camera 14 produces an image of the reflecting surfaces in the area resulting from retroreflected radiation at the first wavelength whereas camera 16 produces an image of the reflecting surfaces in the area resulting from retroreflected radiation at the second wavelength. The cameras 14 and 16 are preferably provided with telephoto camera lens units 54 to provide the variability of magnification needed based on the distance of the area from the cameras 14 and 16. The telephoto camera lens units 54 preferably include a telephoto camera lens motor 55 to alter the magnification of the image received by the camera for examination of the area located at a long or short distance therefrom. The cameras 14 and 16 are preferably vidicon type cameras or ccd (charge coupled device) type cameras. The camera component circuits which produce a voltage used to provide a pixel in the camera image proportional to the intensity of the corresponding retroreflected radiation beam are tapped into and the voltage output thereof is fed to the camera analog to digital converter (or an external analog to digital converter depending on the type of camera utilized) and the digital output thereof is transmitted to the computer for processing thereby. The camera circuits which provide a voltage or current used to provide a pixel in the camera image at a location representative of the location of the corresponding reflecting surface which reflects the corresponding retroreflected radiation beam to the camera are tapped into and the voltage or current output thereof is fed to the camera analog to digital converter (or an external analog to digital converter depending on the type of camera utilized), and the digital output thereof is transmitted to the computer 22 for processing thereby. Such circuits may, for example, include sweep generator circuits which are used in some types of cameras.

A pair of night vision devices or image intensifiers 50 and 52 are preferably also provided and positioned between the separator 30 and the cameras 14 and 16. The image intensifiers 50 and 52 amplify the radiation signal fed into the cameras 14 and 16 (after unwanted radiation such as that from the sun or moon has been filtered out) where the laser 32 which is utilized is of relatively low power or where the area to be examined is a long distance from the cameras 14 and 16. Consequently, the image intensifiers 50 and 52 need not be used where the retroreflected radiation is deemed of sufficient intensity to provide adequate data to enable calculation of the desired parameters and determination of the desired conclusions.

The range circuitry subsystem 21 preferably includes a counter 20, a modulator 62, a demodulator 66 and a phase detector 64. The modulator 62 is electrically connected to the driver 34 for mixing a modulating signal with the laser beam. The modulating signal is preferably of a sufficiently long wavelength to permit the application of standard range finding techniques. Alternatively, two modulating signals producing a beat signal may be utilized. The demodulator 66 is electrically connected to the cameras 14 and 16 for demodulating the radiation received thereby. The phase detector 64 is electrically connected to both the modulator 62 and the demodulator 66 and detects and compares the phase of the modulating signal of the transmitted radiation to the phase of the modulating signal of the received radiation. The counter 20 and the phase detector 64 are electrically connected to the computer 22 for calculation of the range.

Figure 5A:
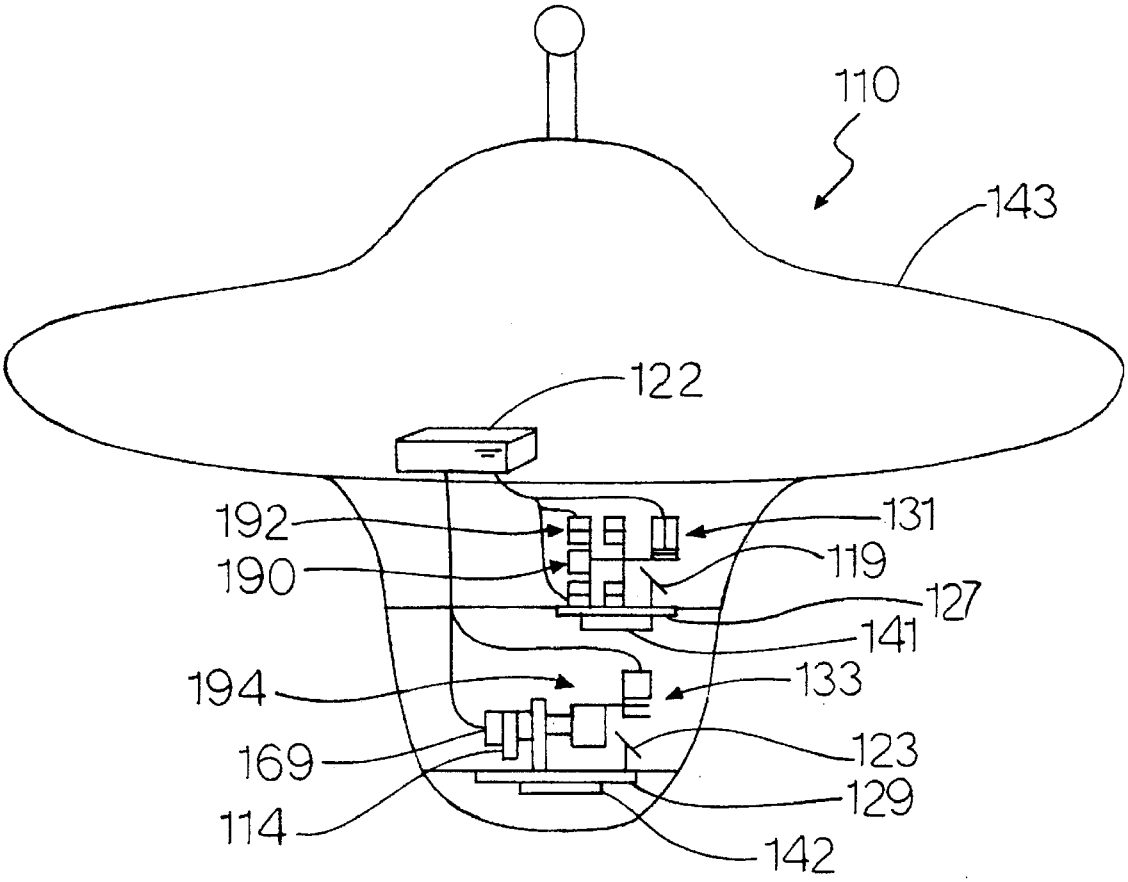
FIG. 5A is a perspective view of a second embodiment of the detector system showing components thereof mounted in a housing and on a pair of rotatable mounts in order to scan a relatively large area and showing the housing in cross-section in order to depict the detector system components positioned in the housing.

FIG. 5A shows the second embodiment of the detector system of the present invention generally designated by the numeral 110. The second embodiment of the detector system 110 is preferably mounted in housing 143 and includes an area sensor assembly 192 and a target identification assembly 194. The area sensor assembly 192 includes a first laser assembly 131 and the target identification assembly 194 includes a second laser assembly 133 which are used for irradiating an area in order to examine the area for the presence of an observer. The area sensor assembly 192 is used to provide azimuth, elevation and range determinations of objects in the area which retroreflect light to the assembly 192. The target identification assembly is used to determine the presence of human eyes in the area as well as their orientation and also determine azimuth, elevation and range of more particularly the eyes. The detector system 110 also includes a light sensor and current detector assembly 190 used in conjunction with the first laser assembly 131 and a camera 114 and video image digitizer 169 used in conjunction with the second laser assembly 133. The detector system 110 also includes a computer 122 which is electrically connected to the first and second laser assemblies, the light sensor and current detector assembly 190 and the video image digitizer 169. The area sensor assembly 192 is preferably mounted on a mount 127. The target identification assembly 194 is preferably mounted on a mount 129. The mounts 127 and 129 are preferably movable and, more preferably, rotatable so that the laser assemblies 131 and 133 can irradiate (or illuminate) an area larger than their fields of irradiation (or illumination) and concomitantly so that the camera 114 and the light sensor and current detector assembly 190 can receive radiation reflected from an area larger than the field of irradiation of the laser assemblies 131 and 133. The direction of the light beams from the laser assemblies 131 and 133 are preferably coaxial with the corresponding light receiving components of the light sensor and current detector assembly 190 of the area sensor assembly 192 and with the corresponding light receiving components of the target identification assembly 194.

Figure 5B:
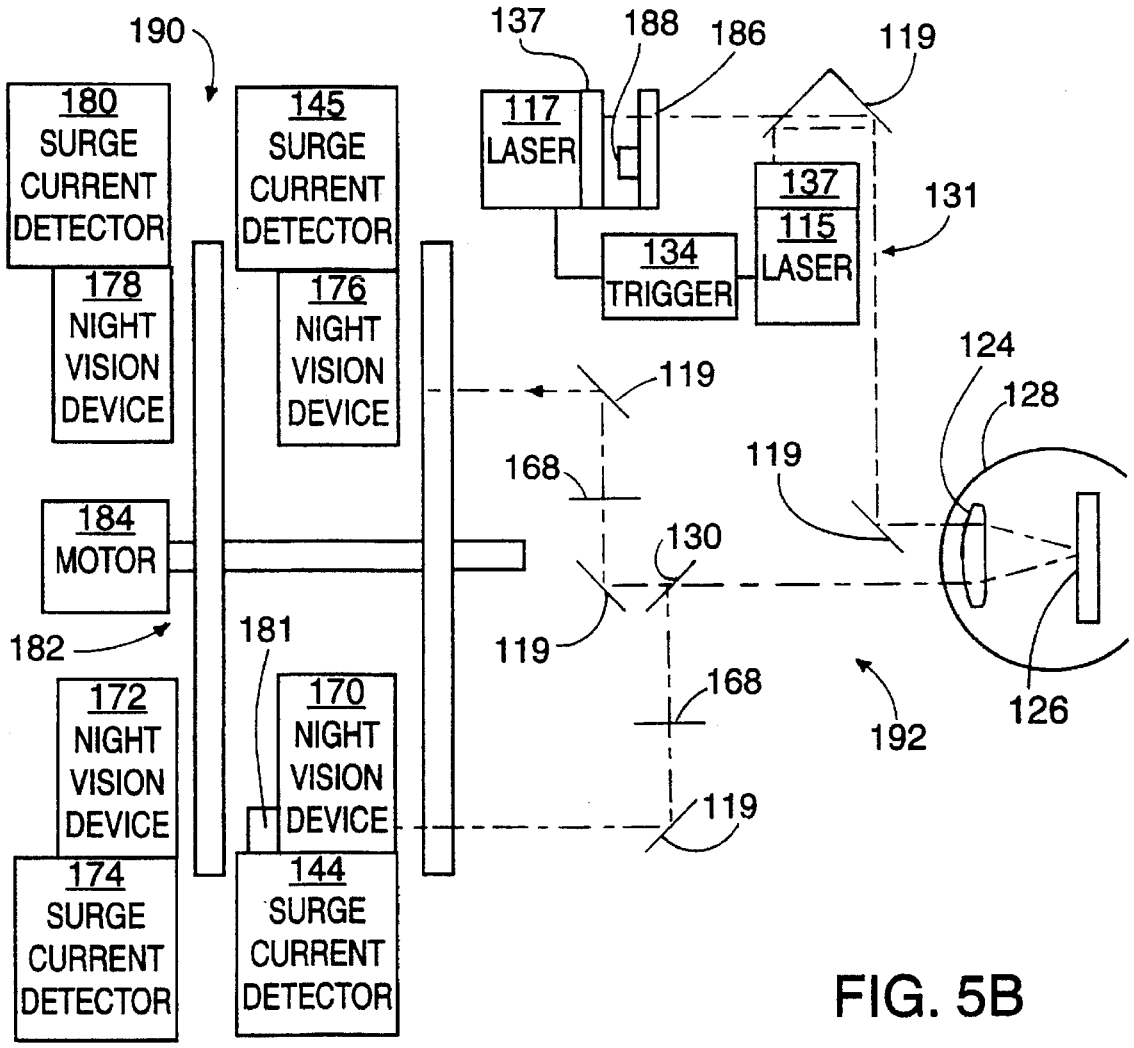
FIG. 5B is a diagram of a component assembly of the second embodiment of the detector system of the present invention showing light emitted from a pair of lasers reflected from an eye back to components of the detector system for processing thereof.

FIG. 5B is a diagrammatic view of the area sensor assembly 192 showing the first laser assembly 131 irradiating the eye lens 124 and retina 126 of a human eye 128. As with FIG. 4B, FIG. 5B illustrates how the lens 124 refracts the radiation impinging thereon so that the ray is directed to and reflected from the retina 126 back to the lens 124 which refracts the ray so that it travels away from the lens 124 in a direction which is opposite to but parallel to the initial direction of propagation of the ray. The laser assembly 131 preferably includes a first sensor laser 115 and a second sensor laser 117. The first sensor laser 115 is used as a range-finder, and for this reason it is preferably a GaAs laser (or a Nd YAG laser) since this type of laser can be triggered to provide a sharp pulse. These sharp pulses can be easily distinguished from solar specular returns as the latter offers a long continuous signature. The GaAs first sensor laser 115 is preferably pulsed at approximately one thousand pulses per second in order to provide pulsing suitable for standard range finding techniques. The second sensor laser 117 is not used as a range-finder but its signature must similarly be distinguished from unwanted specular returns. Consequently, the second sensor laser 117 is artifically chopped with a spinning single reticle 186 which is positioned in the path of the light emitted therefrom and which is rotated at approximately twenty four hundred rpm via a single reticle motor 188. The single reticle 186 preferably has approximately one hundred slots (not shown) which alternately pass and block the laser light. As a result, the second sensor laser 117 is pulsed at approximately four kpps. A suitable first laser trigger or control 134 is operatively connected to the first and second sensor lasers 115 and 117. As with embodiment 10, the light emitted from both the sensor lasers 115 and 117 have a predetermined amplitude or intensity. The laser beam is subsequently expanded by a pair of first laser lenses 137 positioned at the output of the lasers 115 and 117 so that the rays of the beam of radiation diverge with respect to each other. The divergence of the rays of the laser beam enables the irradiation of an area which is large relative to the width of the collimated i.e., prior to divergence, laser beam. Thus, the field of irradiance of the lasers 115 and 117 is large which thereby enables the examination of a relatively large area. The beams of radiation preferably have even flux distributions in order to enhance accuracy of the calculations of the desired parameters. The laser lenses 137 are preferably telephoto laser lenses 137 which each includes a first telephoto laser lens motor 139 to alter the magnification of the lens 137 to irradiate a larger or smaller portion of the area, as desired.

The laser radiation which is retroreflected from eyes and other objects in the area is received by a preferably prism type of separator 130 which separates the radiation into beams of different wavelengths. A pair of second interference filters 168 positioned in the path of the beams of different wavelengths filters out unwanted radiation leaving radiation having only the wavelengths of the laser assembly 131 and specifically as limited by the first interference filters 136. A first set of mirrors 119 reflects and directs the beams into the light sensor and current detector assembly 190. The individual mirrors of the set of mirrors 119 and components of the light sensor and current detector assembly 190 are positioned so that the path of the beams from the separator 130 to the assembly 190 are equal.

Figure 5C:
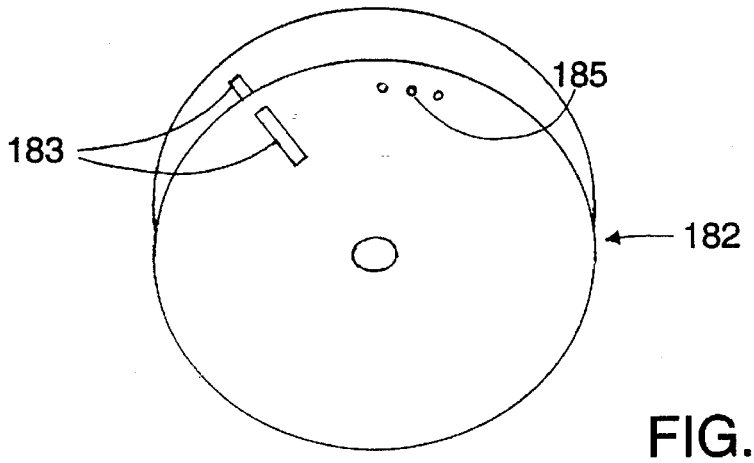
FIG. 5C is a perspective view of a dual reticle component of the second embodiment of the present invention showing the slits and holes in bottom surfaces thereof.

There are preferably two pairs of night vision devices (or tubes) in the light sensor and current detector assembly 190. These night vision devices include first and second primary night vision devices or tubes 170 and 176 and first and second secondary night vision devices or tubes 172 and 178. The light sensor and current detector assembly 190 preferably also includes a dual reticle 182 and dual reticle motor 184 for rotation thereof. The dual reticle 182 has preferably thin slits which are preferably radially oriented and in alignment with each other in the direction of the axis of rotation, as shown in FIG. 5C. The dual reticle 182 which spins at preferably twelve hundred rpm alternately blocks and allows passage of laser radiation therethrough into the night vision devices 170, 172, 176 and 178 positioned below the dual reticle 182 and in the path of the laser radiation. Thus, the dual reticle 182 essentially functions to provide the location or position of the received light sensed by the night vision devices. The determination of the angular position of the dual reticle slits 183 which light pixels pass therethrough and which are received by the corresponding night vision devices 170, 172, 176 or 178 provides the determination of the particular location of the light pixel in the image received by that night vision device. Moreover, the field of view of the primary night vision devices 170 and 176 is oriented at right angles i.e., orthogonal, to the field of view of the secondary night vision devices 172 and 178. This enables either the primary or secondary night vision devices 170, 176, 172 and 178 to be utilized to provide azimuth measurements while the other of the night vision devices are utilized to provide elevation measurements.

The angular position of the dual reticle 182 is measured by means of a dual reticle light emitting diode 181 and a set of dual reticle holes 185 which are in alignment relative to the axis of rotation of the dual reticle 182 at a particular angular position of the dual reticle 182. The light emitting diode 181 is preferably mounted at the outer periphery of the primary night vision device 170, and the set of holes 185 are preferably mounted at the outer periphery of the bottom one of the dual reticles 182, as shown in FIG. 5C. The set of holes 185 are preferably three pinholes. The light emitting diode 181 and set of holes 185 are preferably positioned so that when the dual reticle is at a particular angular position the light from the light emitting diode 181 shines into the night vision device 172, as shown in FIG. 5B. When a surge current corresponding to the light from the light emitting diode 181 is registered in the surge current detector 174, a determination is made by the computer 122 that the dual reticle is at a particular start count position. When surge current corresponding to a light pixel of the light received from the area is registered in the surge current detector 174 (or any of the other surge current detectors 144, 145 or 180), the computer 122 acquires the count from the counter 120 corresponding to the time of that surge current registration and makes a determination regarding the angular position of the slit 183. The computer utilizes these measurements of the angular position of the slit 183 to make determinations regarding the location (both azimuth and elevation) of the light pixels in the images received by the night vision devices 170, 172, 176 and 178. The computer 122 relates these measurements to the orientation data from the first and second mount controls 141 and 142 and to field of irradiation data from the fourth databank and from the laser lens motors 139 and 149 and calculates azimuth and elevation parameters of the objects in the area.

The area sensor assembly 192 is preferably used for range determination of the retroreflecting objects in the area. With the GaAs laser 115 pulsed at one thousand pulses per second, a maximum of fifty returns are acquired by the primary night vision device 170 with each spin of the dual reticle 182. Integration of the returning pulses increases the sensitivity by a factor of approximately seven. The range calculation Is made by utilization of the transit time measurement made by acquiring the time of transmission of the laser pulse and the time of arrival of the laser pulse from the first sensor laser 115. A counter 120 starts the count at the time of transmission of a laser pulse in response to such data from the first laser trigger and stops the count at the time of arrival of the laser pulse in response to such data from the The computer 122 acquires the time of transmission data from the first sensor laser trigger 134 and acquires the time of arrival data from the first primary surge detector 144 and controls the count of the counter 120 in accordance therewith.

The area sensor assembly 192 is also used for comparison of the intensity or amplitude of the pixels of light retroreflected from the area. Thus, as with the first embodiment 10, the two wavelengths of the radiation are selected to provide maximal intensity return from human eyes and the other provides maximal intensity return from eyes of an animal species. The intensity measurements are compared and utilized for a determination regarding the presence of human eyes, as with the first embodiment.

The surge current detectors 144, 145, 174 and 180 also provide measurements of the intensity of the pixels of the image received by the vision devices 170, 172, 176 and 178. Thus, this enables measurement of the relative intensities of the retroreflected light having the two selected wavelengths. In addition, the surge current detectors 144 and 145 have a rise time enabling the data therefrom to be used to determine whether the light received by the vision devices 170 and 176 is unpulsed or not pulsed characteristically of the pulsed light from the lasers 115 and 117 and thereby a determination and elimination of radiation from extraneous sources. The surge detectors 144 and 145 thus function as pulse filters.

Figure 5D:
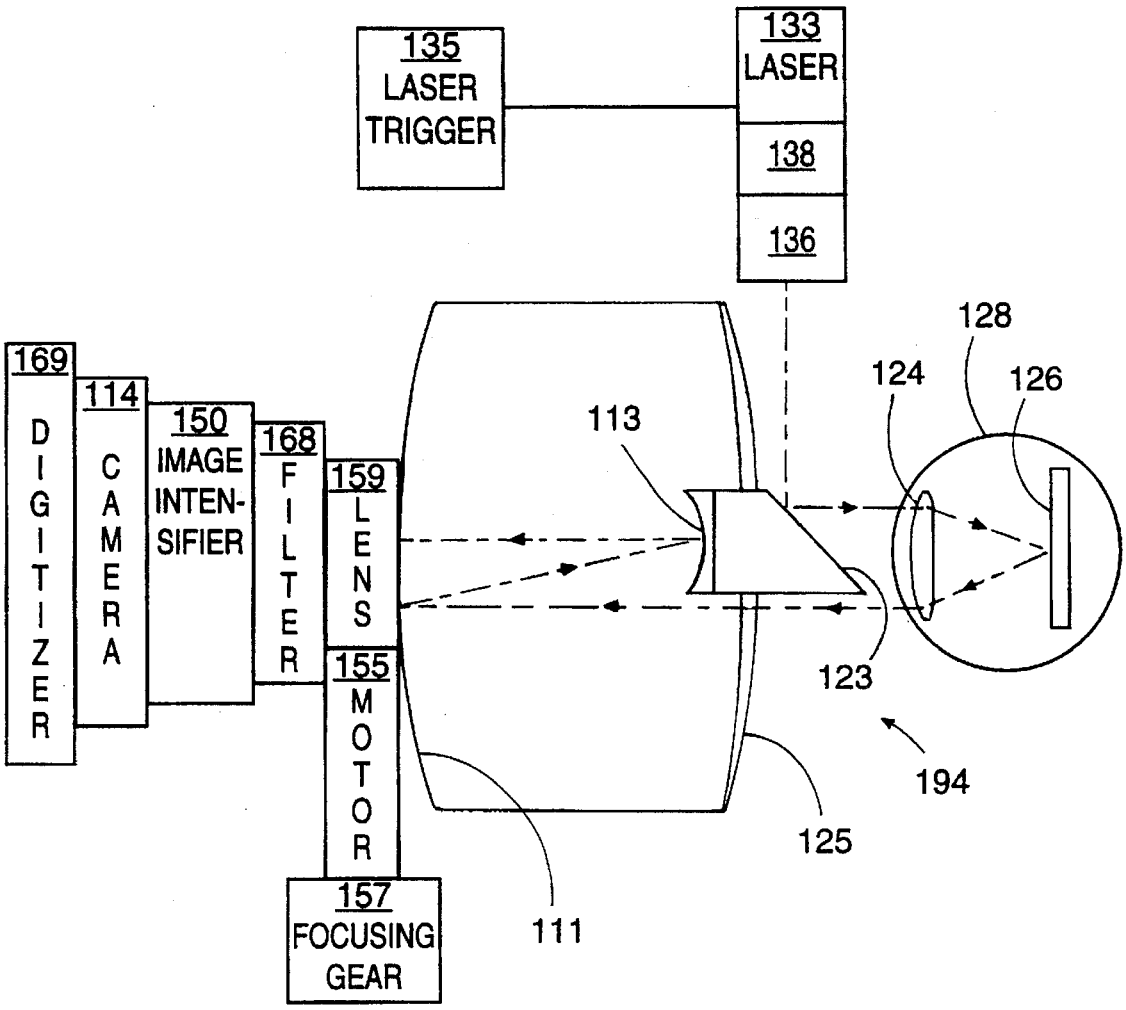
FIG. 5D is a diagram of another component assembly of the second embodiment of the detector system of the present invention showing light emitted from a laser reflected from the eye back to components of the detector system for processing thereof.

FIG. 5D is a diagrammatic view of the target identification assembly 194 showing the second laser assembly 133 irradiating the lens 124 and retina 126 of the human eye 128. Essentially, the target identification assembly 194 is used to determine whether the retroreflecting objects in the area include human eyes. As with FIGS. 4B and 5B, FIG. 5D illustrates how the lens 124 refracts the radiation impinging thereon so that the ray is directed to and reflected from the retina 126 back to the lens 124 which refracts the ray so that It travels away from the lens 124 in a direction which is opposite to but parallel to the initial direction of propagation of the ray. The target identification assembly 194 includes only preferably a single GaAs low power laser 133 which is preferably pulsed as is laser 115. A suitable second laser trigger or control 135 is operatively connected to the laser assembly 133. A second preferably telephoto lens 138 is positioned in the path of the laser beam emitted from the laser 133 in order to provide a divergent beam for irradiation of a desired portion of the area. The range of magnification of the telephoto lens 138 is preferably two to ten times (but may vary from this depending on application). The telephoto lens 138 preferably includes a second telephoto lens motor 149. A first interference filter 136 restricts the light emitted from the laser 133 to only a particular desired wavelength (preferably approximately 0.90 microns).

A second mirror 123 reflects and directs the beam emitted from the second laser 133 so that it irradiates the desired area. The retroreflected light from the area passes through a Matzukoff or Matzukoff like correction lens 125 and is reflected from a primary mirror 111 onto a secondary mirror 113. The mirrors 111 and 113 together function as a telescope type of device to assist in measuring separation of the pixels of light from the area. The secondary mirror 113 reflects the light into a camera lens unit (preferably telephoto) 154. A camera telephoto lens motor 155 and a camera telephoto lens focusing gear 157 are connected to the lens unit 154 for control thereof. A second interference filter 168 positioned in the path of the light passing through the lens unit 154 restricts the light to the wavelength of the laser 133 thereby filtering out extraneous radiation. An image intensifier (or suitable night vision device) 150 takes the retroreflected returns and intensifies them on its phosphors and the glowing image provided by the phosphors is received by the video camera 114. The image received by the video camera (or other type of vision device) 114 is digitized by the video image digitizer and transmitted to the computer 122. The video camera and digitizer 169 transmit data to the computer 122 regarding the separation of the pixels of image of the camera 114 and thereby the angular separation of the light from the probable pair of human eyes 128 and the computer uses this data in conjunction with databank data relating to the separation limits of human eyes to determine if the pixels of light are in fact from human eyes. The target identification assembly 194 also is capable of stopping and staring at a particular portion of the target area while the area sensor assembly 192 is rotating and scanning the area in order to analyze light retroreflected therefrom to determine if the reflecting objects are human eyes. The computer also calculates the range of the probable human eyes by utilizing the time of transmission data from the second laser trigger 135 in conjunction with the time of arrival data from the camera 114 and digitizer 169 and in conjunction with the counter 120 as with the range calculation method for the area sensor assembly 192. These computer determinations together provide determinations regarding the orientation of the human eyes and determinations regarding the line of sight thereof.

Figure 9:
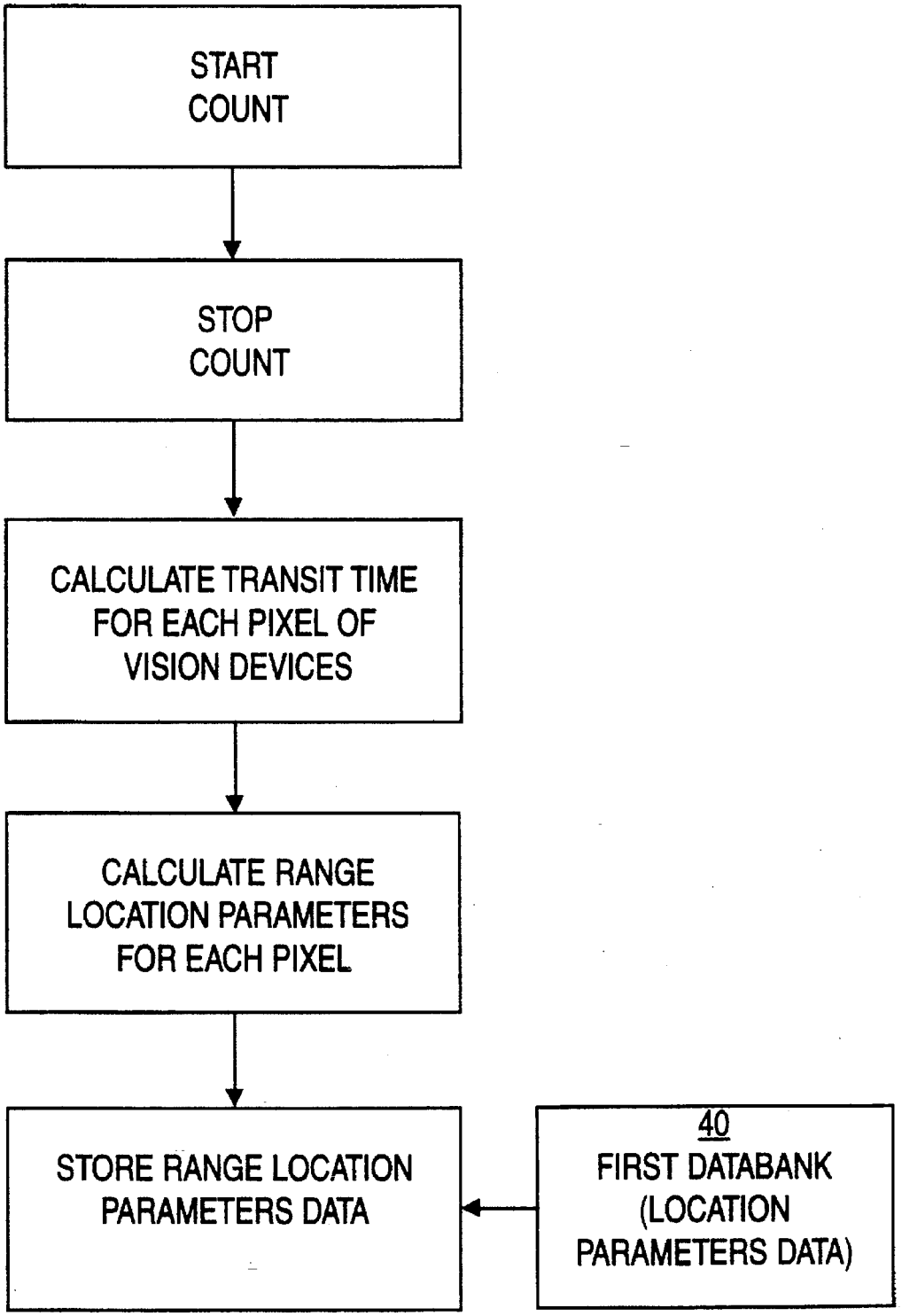
FIG. 9 is a flowchart of a third software program of the detector system of the present invention utilized to determine range location parameters of the observers and objects in the area examined.

The computer 22 has a third software program (shown in FIG. 9) which starts the count of the counter 20 at a predetermined point in the phase of the emitted laser radiation and stops the count of the counter 20 at that predetermined point in the phase of the received laser radiation which is reflected from the reflecting surfaces in the area into each camera 14 and 16 for every pixel of the image of each camera 14 and 16 for the first embodiment 10. The computer 122 also has the third software program which starts the count of the counter 20 at the time of transmission of the laser pulse from laser assembly 131 and/or 133 and stops the count of the counter 20 at time of arrival of the laser pulse at the night vision device 170 and/or the video camera 114 for the second embodiment 110. The third software program uses the digital count data from the electrical output of the counter 20 to calculate transit time for each pixel and the transit time to calculate range or distance of the reflecting surfaces corresponding to each pixel of the image of each camera 14 and 16. The range calculations data are stored in a first databank 40.

The computer 22 has a first software program (shown in FIG. 7) which acquires the intensity (or signal amplitude) data from the camera output for each pixel of the camera image and calculates signal intensity for each of the pixels of the image of each camera for the first embodiment 10. The computer 122 has the first software program which acquires the intensity (or signal amplitude) data from the surge current detectors 144, 145, 178 and 180 and from the camera 114 for each of the pixels of the image of the vision devices i.e., night vision devices 170, 172, 176 and 178 and the video camera 114, and calculates signal intensity for each of the pixels of the image of each vision device for the second embodiment. The first software program also acquires range locations calculations data from the first databank 40. The first software program combines the intensity calculations with the range calculations for each pixel in the image of each camera 14 and 16 (and other vision device) and compares intensity and range calculation data for each pixel of the image of camera 14 (and other corresponding vision device) to the intensity and range calculation data for each corresponding pixel of the image of camera 16 (and other corresponding vision device). The computers 22 and 122 thus compare the signal amplitude and wavelength for each pixel of each camera image. The difference, if any, is compared to predetermined reference values in a second databank 48, and if the difference exceeds predetermined threshold values in the second databank 48 the computers 22 and 122 provide a determination regarding the presence of a human or nonhuman observer depending on which pixel has the higher intensity value. This determination data regarding the presence of a human observer i.e., human eyes, is stored in a third databank 56.

Figure 8:
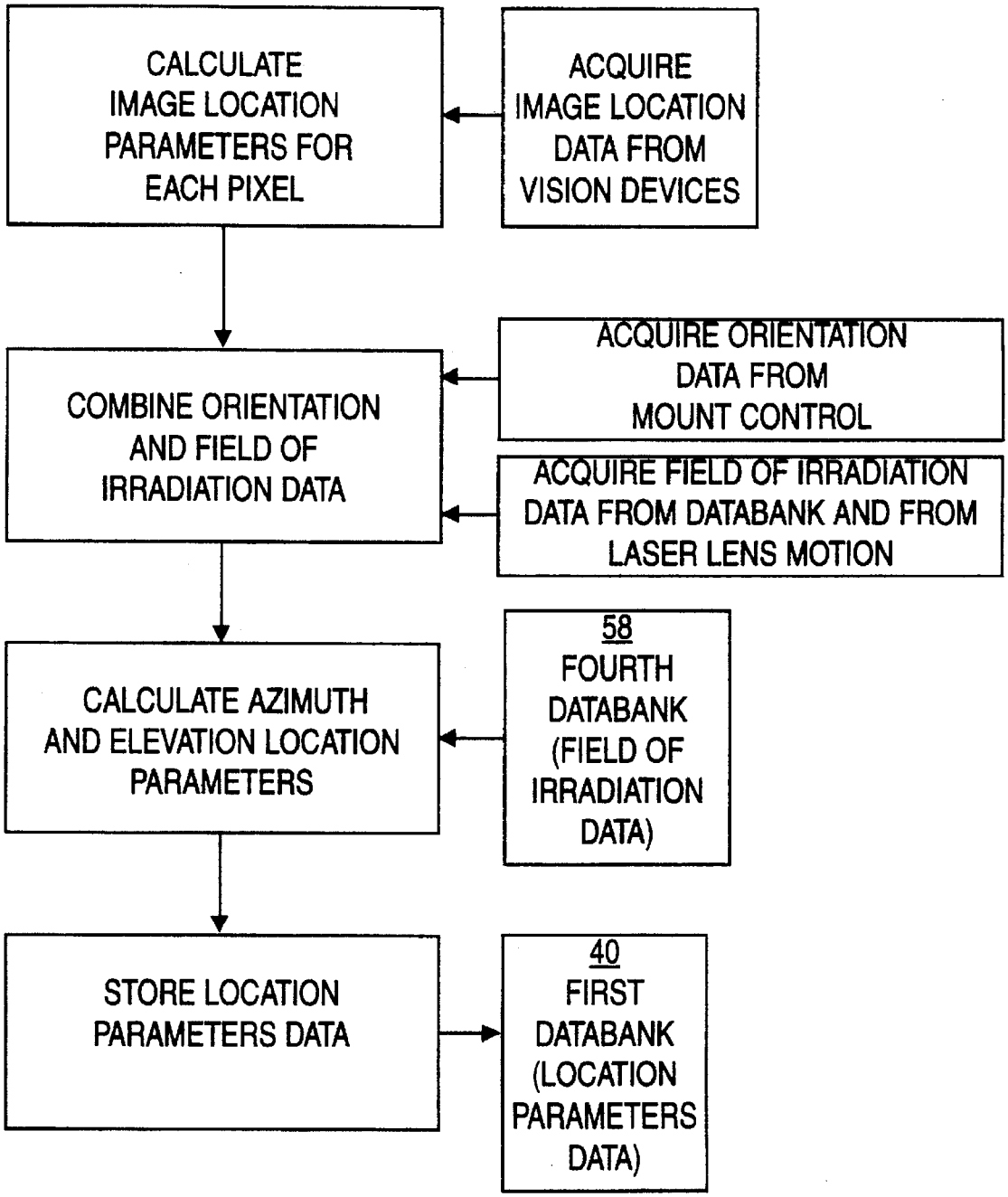
FIG. 8 is a flowchart of a second software program of the detector system of the present invention utilized to determine azimuth and elevation location parameters of the observers and objects in the area examined.

The computer 22 also has a second software program (shown in FIG. 8) which acquires the location data from the camera output for each pixel of the camera image. The second software program also acquires data from the mount control 42 (which is connected to and controls the orientation of the mount 27) relating to the orientation of the laser 32 and also acquires data relating to the field of irradiation of the laser 32 from a fourth databank 58. Since the location data from the camera output is essentially data pertaining to vertical and horizontal position on the image of the camera 14 and 16, the second software program combines the location data with the orientation data and field of irradiation data to calculate azimuth and elevation location parameters of the reflecting surfaces in the area which provide the pixels of the images of the cameras 14 and 16. Thus, the computer 22 provides the three dimensional locations of the observers and objects in the area via its calculation of the azimuth and elevation parameters and range parameters. The azimuth and elevation parameters calculations data are stored in the first databank 40.

Figure 10:
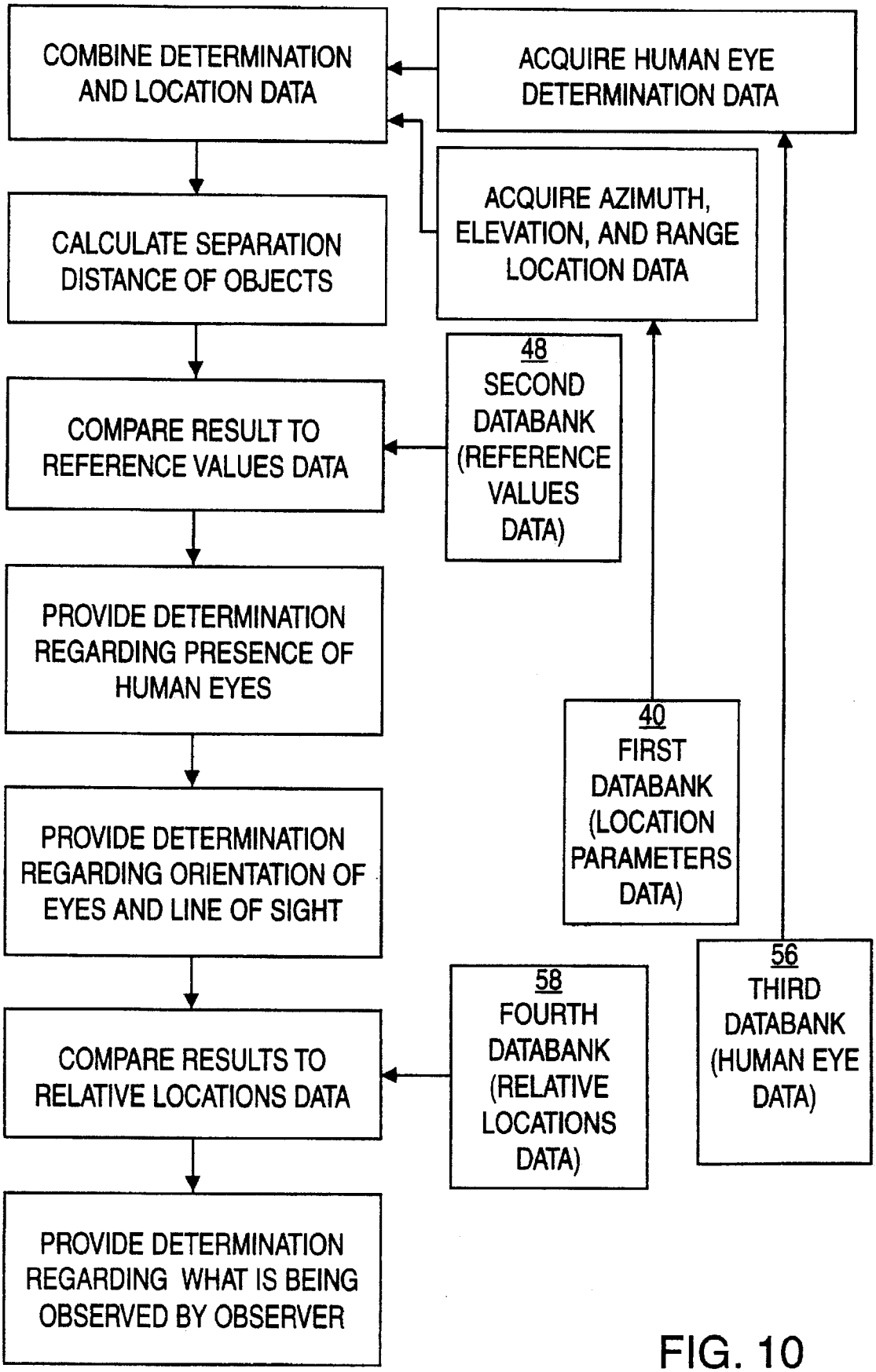
FIG. 10 is a flowchart of a fourth software program of the detector system of the present invention utilized to determine the orientation of the eyes in the area and thereby determine what is being observed thereby and also utilized to differentiate between human observers, nonhuman observers and inanimate objects in the area examined.

A fourth software program (shown in FIG. 10) acquires the determination data regarding the presence of human eyes from the third databank 56 and acquires the calculated azimuth and elevation location data as well as the calculated range location data from the first databank 40. The fourth software program combines these data to calculate the separation distance of the reflecting objects producing pixels in the image of each vision device and compares the results with reference values for a pair of human eyes contained in the second databank 48 and thereby provides a determination regarding the presence of a pair of human eyes and calculates the orientation of the pair of human eyes. The fourth software program utilizes the orientation data to calculate the nominal line of sight of the pair of eyes and a determination of what the observer is or may be observing based on and utilizing data relating to the relative locations of the detection system 10 or 110, the area and other objects, buildings or any other desired artifacts or persons contained as data in a fourth databank. Additionally, an expert may utilize the image data and computer determinations to draw conclusions regarding what the human eyes are looking at.

Figure 11:
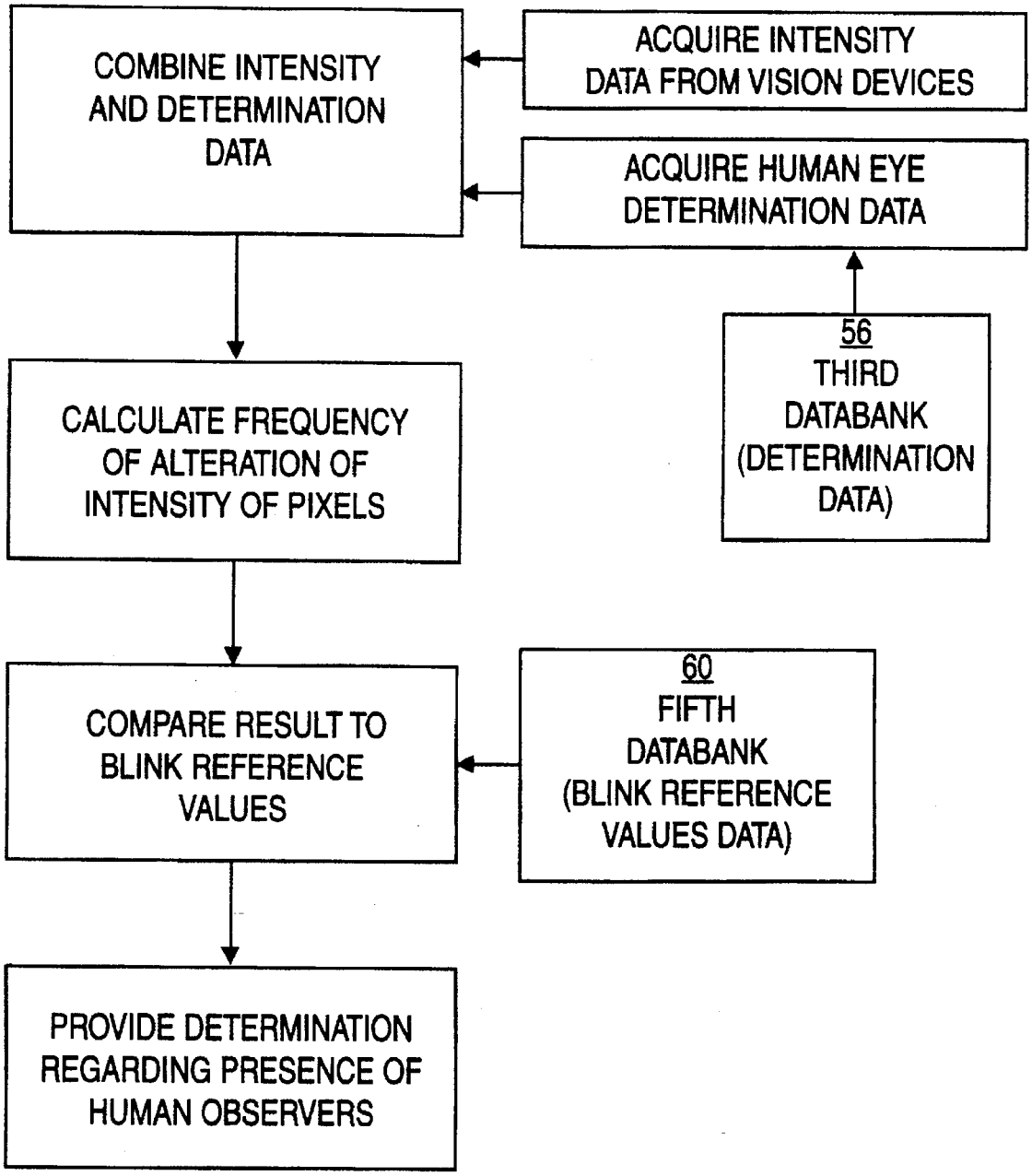
FIG. 11 is a flowchart of a fifth software program of the detector system of the present invention utilized to determine the presence of human eyes in the area by utilizing data relating to alterations in the intensity of the retroreflected light from the reflecting surfaces in the area.

A fifth software program (shown in FIG. 11) acquires the determination data regarding the presence of human eyes and also acquires the intensity data from the cameras 14 and 16 (and the other vision devices). The software program calculates the frequency of alteration of intensity of pixels of the images of the cameras 14 and 16 (and other vision devices). Since human eyes blink occasionally, the fifth software program compares the frequency of alteration of the intensity of the pixels to blink reference values data in a fifth databank 60 and provides a determination as to whether the pixels' alteration of intensity represent blinking human eyes in the area. Thus, this determination can buttress or counter other computer determinations regarding the existence of human observers in the area. In this regard, the mount control 142 may stop the assembly 194 from scanning the area for a desired period of time while the assembly 192 continues to scan the area in order to wait for a blink to make a determination regarding the existence of human observers in the area. Similarly, the mount control 42 may stop the assembly 10 from scanning the area for a desired period of time in order to wait for a blink to make a determination regarding the existence of human observers in the area. Alternatively, the laser assembly 32 may incorporate two lasers one of which is stopped from scanning in conjunction with one of the cameras 14 and 16 in order to view the subject for a sufficient period of time to detect a blink and make the determination regarding the existence of human observers.

Accordingly, there has been provided, in accordance with the invention, a system which detects the presence of human observers in an area and provides their location as well as a determination regarding what the observers are observing and thus fully satisfies the objectives set forth above. It is to be understood that all terms used herein are descriptive rather than limiting. Although the invention has been specifically described with regard to the specific embodiments set forth herein, many alternative embodiments, modifications and variations will be apparent to those skilled in the art in light of the disclosure set forth herein. Accordingly, it is intended to include all such alternatives, embodiments, modifications and variations that fall within the spirit and scope of the invention as set forth in the claims herein below.

What is claimed is:

1. A system for detecting the presence of an observer in an area, comprising:

a source of electromagnetic radiation for irradiating the area to be examined for the presence of an observer;

a vision device for receiving radiation from said source reflected from the area;

means for measuring intensity of the radiation received by said vision device;

means for differentiating between radiation reflected from reflecting surfaces of a human observer, of a nonhuman observer and of an inanimate object, said means for differentiating utilizing data related to intensity measurements of the radiation received by said vision device and proportional to intensity of the radiation reflected from the area.

2. The system of claim 1 further including a means for determining location of the reflecting surfaces by utilizing time measurements of signal characteristics of the radiation from said source and received by said vision device.

3. The system of claim 2 further including a means for determining orientation of the eyes of the human observer relative to said source and said vision device, said means for determining orientation utilizing determined parameters of location of reflecting surfaces of the human observer's eyes and data relating to intensity measurements of radiation reflected from the reflecting surfaces of the human observer's eyes.

4. The system of claim 1 further including:

means for determining location of light pixels in an image of said vision device resulting from radiation received from the reflecting surfaces; and means for correlating location of the light pixels in the image with location of the area irradiated by said source in order to determine azimuth and elevation location parameters of the reflecting surfaces.

5. The system of claim 1 further including:

a driver connected to said source;

a modulator connected to said driver for mixing a modulating signal with the radiation from said source;

a demodulator connected to said vision device for demodulating the radiation from said source;

a phase detector connected to said modulator and to said demodulator for detecting the phase of the modulating signal of the radiation transmitted from said source and of the radiation received by said vision device;

a counter; and a computer connected to said counter and to said phase detector for starting a count of said counter upon detection of a predetermined point in the phase of the transmitted signal and stopping the count of said counter upon detection of the predetermined point in the phase of the received signal for determining time of irradiation of the reflecting surfaces and time of arrival at said vision device of radiation reflected from the reflecting surfaces in order to determine range location parameters of the reflecting surfaces.

6. The system of claim 1 wherein said means for differentiating includes a first interference filter positioned at an output of said source for providing electromagnetic radiation therefrom radiated at a first wavelength and radiated at a second wavelength, the first wavelength selected so that it provides maximal reflection from a human eye, the second wavelength selected so that it provides maximal reflection from a nonhuman eye of a species commonly found in the area.

7. The system of claim 1 further including a means for eliminating reflected radiation received from said source from the combination of reflected radiation from extraneous sources and reflected radiation from said source and received by said vision device utilizing pulsation characteristics of the radiation received by said vision device.

8. The system of claim 7 wherein said means for eliminating includes:

a trigger connected to said source for activating and deactivating said source in order to provide pulsed radiation therefrom irradiating the area; and a pulse filter positioned at input of said camera in order to filter undesired radiation from radiation received by said camera.

9. The system of claim 1 further including a lens positioned at the output of said source in order to provide a beam of the radiation having rays which diverge with respect to each other, the beam produced by said source for irradiating a desired portion of the area, the beam having an even flux distribution.

10. The system of claim 1 wherein the radiation from said source is in the invisible infrared portion of electromagnetic radiation spectrum.

11. The system of claim 1 further including:

a mount, said source mounted on said mount;

a mount control, said mount control allowing said mount to be movable in order to allow said source to scan a desired area larger than a field of irradiation of said source, said mount control allowing said mount to be fixed in a desired position in order to view a desired area for a desired period of time.

12. A system for detecting the presence of an observer in an area, comprising:

a source of electromagnetic radiation for irradiating the area to be examined for the presence of an observer;

a camera for receiving radiation emitted from said source and reflected from the area, said camera having an electrical output including intensity data relating to intensity of the radiation received thereby and location data relating to location of pixels in an image produced by said camera from the radiation received thereby;

a computer electrically connected to said camera for receiving the output from said camera, said computer having a first software program which utilizes the intensity data to calculate intensity of the pixels of the radiation received by said camera, said first software program differentiating between radiation reflected from reflecting surfaces of a human observer, of a nonhuman observer and of an inanimate object by utilizing the calculated intensity of the pixels of the radiation received by said camera.

13. The system of claim 12 further including a means for monitoring the orientation of said source, said means for monitoring having an electrical output including field of view data for providing said field of view data to said computer in order to enable said computer to determine the location of the area irradiated by said source.

14. The system of claim 13 wherein said computer includes a second software program utilizing the field of view data and utilizing the location data relating to the pixels in said image of said camera resulting from radiation reflected from the reflecting surfaces to determine azimuth and elevation location parameters of the reflecting surfaces in the area irradiated by said source.

15. The system of claim 12 further including:

a driver connected to said source;

a modulator connected to said driver for mixing a modulating signal with the radiation from said source;

a demodulator connected to said camera for demodulating the radiation from said source;

a phase detector connected to said modulator and to said demodulator for detecting the phase of the signal transmitted from said source and of the signal received by said camera;

a counter connected to said phase detector, said counter having an electrical output including count data based on the phase of transmitted radiation from said source and received radiation from said camera; and said computer including a third software program for receiving the output from said counter and receiving data from said camera relating to pixels of radiation received from the area and combining the data from said counter and said camera to calculate transit time of the pixels of radiation at said camera, said third software program utilizing transit time calculations to calculate range location parameters of the reflecting surfaces in the area.

16. The system of claim 15 wherein said computer includes a fourth software program utilizing the range location parameters calculations data and the location data to determine separation of light pixels of the reflected radiation and of the reflecting surfaces in order to determine whether the reflecting surfaces include a pair of eyes and to determine orientation of the pair of eyes.

17. The system of claim 12 further including a first interference filter positioned at an output of said source for providing a pair of beams emitted from said source, one of said pair of beams radiated at a first wavelength and the other of said pair of beams radiated at a second wavelength, the first wavelength selected so that it provides maximal intensity of radiation reflection from a human eye, the second wavelength selected so that it provides maximal intensity of radiation reflection from a nonhuman eye of a species commonly found in the area in order to differentiate between radiation reflected from a human observer and a nonhuman observer.

18. The system of claim 17 further including a second interference filter for receiving the radiation reflected from the area and removing undesired radiation therefrom and a separator for receiving the radiation reflected from the area and separating the reflected radiation into first reflected radiation beams having the first wavelength and second reflected radiation beams having the second wavelength, and wherein said camera includes a pair of cameras, one of said cameras receiving the first reflected radiation beams from said separator and the other of said pair of cameras receiving the second reflected radiation beams from said separator, said first software program comparing the intensity data provided by said one of said cameras to the intensity data provided by the other of said cameras in order to differentiate between radiation reflected from reflection surfaces of a human and a nonhuman observer.

19. A system for detecting the presence of an observer in an area, comprising:

a source of electromagnetic radiation for irradiating the area to be examined for the presence of an observer;

a first interference filter positioned at an output of said source for providing electromagnetic radiation emitted from said source radiated at a first wavelength and radiated at a second wavelength, the first wavelength selected so that it provides maximal intensity of radiation reflection from a human eye, the second wavelength selected so that it provides maximal intensity of radiation reflection from a nonhuman eye of a species commonly found in the area;

means for monitoring orientation of said source, said means for monitoring having an electrical output including field of view data;

a pair of cameras for receiving radiation from said source reflected from the area, said pair of cameras having an electrical output including intensity data relating to intensity of the radiation received thereby and image location data relating to location of pixels in an image produced by said pair of cameras from the radiation received thereby;

a driver connected to said source;

a modulator connected to said driver for mixing a modulating signal with the radiation from said source;

a demodulator connected to said cameras for demodulating the radiation from said source which is reflected from the area and received by said pair of cameras;

a phase detector connected to said modulator and to said demodulator for detecting the phase of the modulating signal of the radiation transmitted from said source and of the radiation received by said cameras;

a counter connected to said modulator and demodulator and having an electrical output including data representing a count based on phase difference of the radiation from said source and the radiation reflected from the area and received by the pair of cameras;

a computer electrically connected to said pair of cameras for receiving the output from said pair of cameras, said computer having a first software program which utilizes the intensity data to provide an intensity calculation of the pixels of the radiation received by said cameras and reflected from the area and comparing intensity calculation data combined with range location data pertaining to one of said pair of cameras to intensity calculation data combined with range location data pertaining to the other of said pair of cameras and comparing the results to reference data in a second databank to differentiate between radiation reflected from reflection surfaces of a human and a nonhuman observer, said first software program comparing the intensity calculation data of said pair of cameras combined with range location data of said pair of cameras to reference data relating to predetermined intensities of pixels of radiation reflected from inanimate objects in the area in the second databank to differentiate between radiation reflected from reflecting surfaces of an observer and of an inanimate object, said computer including a second software program utilizing the field of view data relating to location of the area irradiated by said source and utilizing the image location data relating to the radiation pixels in said image of said cameras resulting from radiation reflected from the reflecting surfaces to determine azimuth and elevation location parameters of the reflecting surfaces in the area irradiated by said source, said computer including a third software program for receiving the output from said counter and receiving data from said pair of cameras relating to pixels of radiation received from the area and combining said data from said counter and said pair of cameras to calculate transit time of the pixels of radiation from said source to said pair of cameras, said third software program utilizing transit time calculations to calculate range location parameters of the reflecting surfaces in the area, said computer including a fourth software program utilizing the range location parameters calculations data and the location parameters data to determine separation of light pixels of the reflected radiation in order to determine whether the reflecting surfaces include a pair of eyes and in order to determine orientation of the pair of eyes, said computer including a fifth software program utilizing the intensity data of pixels of the images of the cameras to calculate the frequency of alteration of intensity of pixels of the images of the cameras, the fifth software program comparing the frequency of alteration of the intensity of the pixels to blink data in a fifth databank to provide a determination as to whether the pixels' alteration of intensity represent blinking human eyes in the area.

20. The system of claim 19 further including:

a trigger connected to said source for activating and deactivating said source in order to produce pulsed electromagnetic radiation emitted from said source; and a pulse filter fox eliminating radiation from extraneous sources from the combination of the radiation from extraneous sources and the radiation emitted from said source and received by said pair of cameras.

21. A system for detecting the presence of an observer in an area, comprising:

a source of electromagnetic radiation for irradiating the area to be examined fox the presence of an observer;

a vision device for receiving radiation from said source reflected from the area;

means for measuring intensity of the radiation received by said vision device;

means for differentiating between radiation reflected from reflecting surfaces of a human observer, of a nonhuman observer and of an inanimate object, said means for differentiating utilizing data related to intensity measurements of the radiation received by said vision device;

means for determining location of light pixels in an image of said vision device resulting from radiation received from the reflecting surfaces; and means for correlating location of the light pixels in the image with location of the area irradiated by said source in order to determine azimuth and elevation location parameters of the reflecting surfaces.

22. The system of claim 21 wherein said means for determining location and said means for correlating location include:

a driver connected to said source;

a modulator connected to said driver for mixing a modulating signal with the radiation from said source;

a demodulator connected to said vision device for demodulating the radiation from said source;

a phase detector connected to said modulator and to said demodulator for detecting the phase of the modulating signal of the radiation transmitted from said source and of the radiation received by said vision device;

a counter; and a computer connected to said counter and to said phase detector for starting a count of said counter upon detection of a predetermined point in the phase of the transmitted signal and stopping the count of said counter upon detection of the predetermined point in the phase of the received signal for determining time of irradiation of the reflecting surfaces and time of arrival at said vision device of radiation reflected from the reflecting surfaces in order to determine range location parameters of the reflecting surfaces.

23. A system for detecting the presence of an observer in an area, comprising:

a source of electromagnetic radiation for irradiating the area to be examined for the presence of an observer;

a vision device for receiving radiation from said source reflected from the area;

means for measuring intensity of the radiation received by said vision device;

means for differentiating between radiation reflected from reflecting surfaces of a human observer, of a nonhuman observer and of an inanimate object, said means for differentiating utilizing data related to intensity measurements of the radiation received by said vision device;

means for determining orientation of the eyes of the human observer relative to said source and said vision device, said means for determining orientation utilizing determined parameters of location of reflecting surfaces of the human observer's eyes and data relating to intensity measurements of radiation reflected from the reflecting surfaces of the human observer's eyes.

24. A system for detecting the presence of an observer in an area, comprising:

a source of electromagnetic radiation for irradiating the area to be examined for the presence of an observer;

a vision device for receiving radiation from said source reflected from the area;

means for measuring intensity of the radiation received by said vision device;

means for differentiating between radiation reflected from reflecting surfaces of a human observer, of a nonhuman observer and of an inanimate object, said means for differentiating utilizing data related to intensity measurements of the radiation received by said vision device, said means for differentiating including a first interference filter positioned at an output of said source for providing electromagnetic radiation therefrom radiated at a first wavelength and radiated at a second wavelength, the first wavelength selected so that it provides maximal reflection from a human eye, the second wavelength selected so that it provides maximal reflection from a nonhuman eye of a species commonly found in the area.

25. A system for detecting the presence of an observer in an area, comprising:

a source of electromagnetic radiation for irradiating the area to be examined for the presence of an observer;

a vision device for receiving radiation from said source reflected from the area;

means for measuring intensity of the radiation received by said vision device;

means for differentiating between radiation reflected from reflecting surfaces of a human observer, of a nonhuman observer and of an inanimate object, said means for differentiating utilizing data related to intensity measurements of the radiation received by said vision device;

a trigger connected to said source for activating and deactivating said source in order to provide pulsed radiation therefrom irradiating the area; and a pulse filter positioned at input of said vision device in order to filter undesired radiation from radiation received by said vision device and thereby eliminate reflected radiation from extraneous sources from the combination of reflected radiation from extraneous sources and reflected radiation from said source and received by said vision device.

26. A system for detecting the presence of an observer in an area, comprising:

a source of electromagnetic radiation for irradiating the area to be examined for the presence of an observer;

a vision device for receiving radiation from said source reflected from the area;

means for measuring intensity of the radiation received by said vision device;

means for differentiating between radiation reflected from reflecting surfaces of a human observer, of a nonhuman observer and of an inanimate object, said means for differentiating utilizing data related to intensity measurements of the radiation received by said vision device;

a mount, said source mounted on said mount;

a mount control, said mount control allowing said mount to be movable in order to allow said source to scan a desired area larger than a field of irradiation of said source, said mount control allowing said mount to be fixed in a desired position in order to view a desired area for a desired period of time.

* * * * *